US009313589B2

(12) United States Patent
Hillbratt et al.

(10) Patent No.: US 9,313,589 B2
(45) Date of Patent: Apr. 12, 2016

(54) METHOD AND SYSTEM FOR CONFIGURATION OF A MEDICAL DEVICE THAT STIMULATES A HUMAN PHYSIOLOGICAL SYSTEM

(75) Inventors: Martin Hillbratt, Lindome (SE); André Sadeghi, Partille (SE); Mark Flynn, Gothenburg (SE)

(73) Assignee: Cochlear Limited, Macquarie University (AU)

( * ) Notice: Subject to any disclaimer, the term of this patent is extended or adjusted under 35 U.S.C. 154(b) by 612 days.

(21) Appl. No.: 13/175,607

(22) Filed: Jul. 1, 2011

(65) Prior Publication Data

US 2013/0006042 A1 Jan. 3, 2013

(51) Int. Cl.
*H04R 25/00* (2006.01)

(52) U.S. Cl.
CPC ..... *H04R 25/70* (2013.01); *H04R 25/305* (2013.01); *H04R 25/606* (2013.01); *H04R 2225/67* (2013.01)

(58) Field of Classification Search
CPC ..... H04R 25/00; H04R 29/00; H04R 3/00
USPC ..... 600/25, 559; 607/55–57; 73/585; 181/129, 130; 381/23.1, 60, 312–331; 623/10
See application file for complete search history.

(56) References Cited

U.S. PATENT DOCUMENTS 4,548,082 A * 10/1985 Engebretson et al. ..... 73/585
5,531,787 A 7/1996 Lesinski et al.
5,772,575 A * 6/1998 Lesinski et al. ..... 600/25
5,833,626 A 11/1998 Leysieffer
5,935,166 A 8/1999 Kennedy
6,154,546 A 11/2000 Uvacek
6,157,861 A * 12/2000 Faltys et al. ..... 607/57
6,205,360 B1 3/2001 Carter et al.

(Continued)

FOREIGN PATENT DOCUMENTS

WO 96/39005 A1 12/1996
WO 97/09863 A1 3/1997

(Continued)

OTHER PUBLICATIONS

S. Gelfand, et al., "Acoustic Reflex Thresolds in Normal and Cochlear-Impaired Ears: Effects of No-Response Rates on 90th Percentiles in a Large Sample," Journal of Speech and Hearing Disorders, vol. 55, 198-205, May 1990.

(Continued)

*Primary Examiner* — Christine H Matthews
(74) *Attorney, Agent, or Firm* — McDonnell Boehnen Hulbert & Berghoff LLP

(57) ABSTRACT

A method and system for automatically configuring a medical device that is at least partially implanted in a human recipient and that includes a transducer arranged to stimulate a physiological system of the recipient, such as a middle-ear implant for instance. The energy level of a signal provided to drive the transducer is progressively increased until there is a threshold electrical change indicative of a threshold change in impedance of the transducer. In the context of a middle-ear implant, for instance, the threshold electrical change indicative of the threshold change in impedance of the transducer may be indicative of the acoustic reflex. The energy level of the signal at that point is then used as a basis to set an operational parameter of the medical device, such as a comfort-level of the middle-ear implant for instance.

31 Claims, 5 Drawing Sheets

(56) References Cited

U.S. PATENT DOCUMENTS

| | | | | |
|---|---|---|---|---|
| 6,208,882 | B1 | 3/2001 | Lenarz et al. | |
| 6,295,467 | B1 | 9/2001 | Kollmeier et al. | |
| 6,370,255 | B1 * | 4/2002 | Schaub et al. | 381/107 |
| 6,415,185 | B1 | 7/2002 | Maltan | |
| 6,496,734 | B1 | 12/2002 | Money | |
| 6,726,618 | B2 * | 4/2004 | Miller | 600/25 |
| 6,788,790 | B1 | 9/2004 | Leysieffer | |
| 7,117,038 | B1 | 10/2006 | Overstreet | |
| 7,292,892 | B2 | 11/2007 | Litvak et al. | |
| 7,447,319 | B2 * | 11/2008 | Miller et al. | 381/60 |
| 7,925,355 | B2 | 4/2011 | Quick | |
| 2002/0026091 | A1 | 2/2002 | Leysieffer | |
| 2004/0172102 | A1 | 9/2004 | Leysieffer | |
| 2007/0156063 | A1 | 7/2007 | Zoth et al. | |
| 2007/0179565 | A1 | 8/2007 | Overstreet et al. | |
| 2009/0245556 | A1 | 10/2009 | Parker et al. | |
| 2010/0106218 | A1 | 4/2010 | Botros | |
| 2010/0145177 | A1 | 6/2010 | Pau et al. | |
| 2010/0222639 | A1 | 9/2010 | Purcell et al. | |
| 2010/0312040 | A1 | 12/2010 | Puria et al. | |
| 2011/0022119 | A1 * | 1/2011 | Parker | 607/56 |
| 2011/0160799 | A1 * | 6/2011 | Mishra et al. | 607/57 |
| 2011/0255731 | A1 | 10/2011 | Ball | |

FOREIGN PATENT DOCUMENTS

| | | | |
|---|---|---|---|
| WO | WO 2011079875 | A1 * | 7/2011 |
| WO | WO 2012149945 | A1 * | 11/2012 |

OTHER PUBLICATIONS

C. Kamm, et al., "Effect of Sensorineural Hearing Loss on Loudness Discomfort Level and Most Comfortable Loudness Judgments," Journal of Speech and Hearing Research, vol. 21, 668-681, Dec. 1978.

R. Clement, et al., "Measuring the Electrical Stapedius Reflex with Stapedius Muscle Electromyogram Recordings," Annals of Biomedical Engineering, vol. 30, 169-179, 2002.

PCT Search Report, PCT Application No. PCT/IB2012/053212, dated Jan. 3, 2013.

Supplemental European Search Report for European Patent application No. EP 12 80 7906, dated Dec. 12, 2014.

* cited by examiner

METHOD AND SYSTEM FOR CONFIGURATION OF A MEDICAL DEVICE THAT STIMULATES A HUMAN PHYSIOLOGICAL SYSTEM

BACKGROUND

When a medical device such as hearing prosthesis is implanted in a human recipient, there is generally a need to configure the device with one or more operational settings to help ensure comfortable use of the device by the recipient. Further, as the device is used over time, there may be a need to recalibrate or adjust configuration of the device, to help ensure continued comfortable use.

A typical hearing prosthesis, for example, functions to receive auditory signals and to correspondingly stimulate the recipient's hearing system, for instance by aiding in conduction of sound waves to or through the ear canal or middle ear, or by directly or indirectly stimulating the recipient's auditory nerve or brain stem. In practice, such a prosthesis may thus be programmed or otherwise arranged to map between various levels of received auditory signals and corresponding levels of stimulation to be applied.

One of the operational parameters or settings of such a prosthesis is a maximum comfort level, or "C-level", which defines the maximum allowable level of stimulation that does not produce an uncomfortable loudness sensation for the recipient. Ideally, the C-level should be set to a level that is high enough to allow adequate stimulation to the recipient but to avoid overstimulation and possibly resulting pain or injury to the recipient.

In general, the C-level for a given prosthesis may vary from person to person and must therefore be individually set for a person after implantation of the prosthesis. Conventionally, this "fitting" or configuration process is manually carried out by an audiologist, clinician, or other healthcare professional, by applying stimulation pulses and then receiving an indication from the recipient as to the hearing perception and the level of comfort of the resulting sound.

Unfortunately, however, this fitting process is typically quite time consuming. Further, in locations where there is a lack of adequate audiological infrastructure and/or trained clinicians, a hearing prosthesis may not be optimally fitted for each particular recipient. Moreover, since this fitting procedure relies on subjective measurements, children and prelingually deaf or congenitally deaf patients are often unable to provide an adequate impression of the hearing sensation resulting from the stimulation test pulses. This further complicates the process, potentially resulting in poor fitting of the prosthesis.

Yet further, it would be desirable to provide a mechanism to perform this fitting process during or immediately after surgical implantation of the prosthesis, to help ensure that the implant is performing properly before closing up the patient. Again in this scenario, however, it may be impossible to obtain subjective feedback from the recipient.

SUMMARY

The present disclosure provides an improved method and corresponding system for configuring a medical implant such as a hearing prosthesis. In particular, the disclosure relates to a medical device that is at least partially implanted in a human recipient and that includes a transducer arranged to stimulate a physiological system of the recipient. An example of such a device is a middle-ear implant in which a transducer is vibrationally coupled with the middle ear and functions to induce vibrations of the cochlea that correspond with externally received auditory signals, so as to help improve hearing.

In one respect, the disclosed method involves successively increasing the energy level of a signal that drives the transducer until a determination is made that there is a threshold electrical change indicative of a threshold change in impedance of the transducer, and then using the energy level of the signal at that point as a basis to set an operational parameter of the medical device. By way of example, the energy level of the signal at the point of threshold pressure change in the recipient can be used as a basis to set a maximum allowable energy level for the signal, on grounds the threshold change in pressure may correspond with a comfortable limit of stimulation.

While the disclosed method may be usefully applied with respect to various types of medical implants, the method is particularly useful with respect to middle-ear implants of the type described above for instance. In that context, the threshold electrical change indicative of the threshold change in impedance of the transducer may directly correspond with the occurrence of an acoustic reflex (e.g., stapedius reflex or tensor tympani contraction), and the acoustic reflex may have a defined, or at least somewhat predictable, relationship with an uncomfortable loudness level for the recipient. Therefore, when the threshold electrical change is detected in the recipient upon increase of the energy level that drives the transducer, a reasonable assumption is that the recipient experienced an acoustic reflex at that new energy level. Consequently, it would be advantageous to use that new energy level as a basis to set a maximum allowable energy level of the signal that drives the transducer, to help ensure comfort for the recipient.

In another respect, the disclosed method may involve successively increasing the energy level of a signal that drives the transducer until a determination is made that there is a threshold change in pressure in the recipient, and then using the energy level of the signal at that point as a basis to set an operational parameter of the medical device. By way of example, the energy level of the signal at the point of threshold pressure change in the recipient may be indicative of a threshold change in impedance of the transducer and may therefore be used as a basis to set a maximum allowable energy level for the signal, on grounds the threshold change in impedance of the transducer may correspond with a comfortable limit of stimulation.

Several example methods and corresponding arrangements are disclosed for detecting such a threshold change in pressure in the implant recipient. According to one method, the threshold change in pressure is detected by detecting a threshold change of impedance of the transducer itself. The theory here is that when the acoustic reflex occurs, the contraction caused by the acoustic reflex will cause the transducer to change position in relation to the oval window of the ear or in relation to its initial position, and that change in position of the transducer will result in a change in mechanical impedance against which the transducer works, which may in turn result in a change in electrical impedance of the transducer. In practice, this change in impedance of the transducer can be conveniently detected by measuring a disproportionate change in current or voltage across a circuit component that is in series with the transducer, such as another electrical component of the implant system.

According to another method, the threshold change in pressure is detected by applying a microphone in the recipient's ear canal, preferably isolated from external acoustics by an earplug, to detect a change in pressure. The theory here is that the acoustic reflex would tend to change the pressure in the recipient's air canal, and a microphone would pick up that change in pressure and present the change as a corresponding electrical signal. Advantageously, since an acoustic reflex may occur bilaterally, a microphone placed in one ear of the recipient may detect the change in pressure caused by a middle-ear implant positioned in the recipient's other ear.

These as well as other aspects, advantages, and alternatives will become apparent to those of ordinary skill in the art by reading the following detailed description, with reference where appropriate to the accompanying drawings. Further, it should be understood that the description throughout by this document, including in this summary section, is provided by way of example only and therefore should not be viewed as limiting.

DETAILED DESCRIPTION

Figure 1:
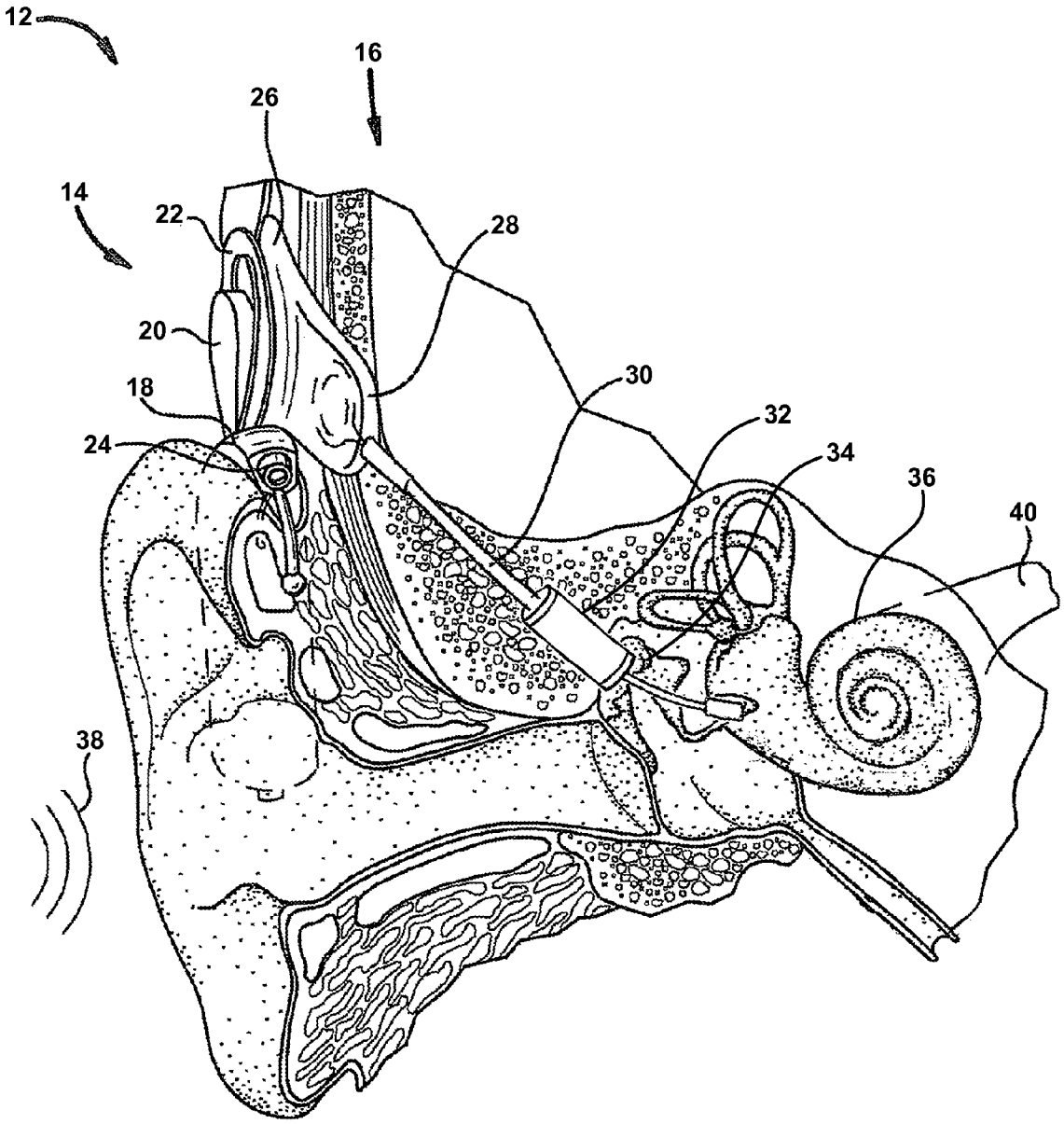
FIG. 1 is a diagram of an example medical device or system operable within the present method.

The present method will be described herein principally with respect to a medical device of the type comprising a transducer vibrationally coupled with a recipient's middle-ear. However, the method is not necessarily restricted to that specific arrangement and could apply as well with respect to other medical devices now known or later developed, including but not limited to bone anchored hearing aid devices or other devices for instance.

Referring to the drawings, as noted above, FIG. 1 is a diagram of an example medical device or system 12 comprising an external component assembly 14 and an internal (e.g., implanted) component assembly 16. Although certain components of the medical device are thus shown being external to the recipient and other components are shown being implanted within the recipient, it will be understood that variations are possible. For instance, certain control and processing components that are shown external to the recipient may instead be provided internal to the recipient. Indeed, with progress in technology, it may be possible for the entire medical device to be implanted in the recipient, perhaps with the exception of a discretely positioned external microphone and/or inductively coupled battery unit.

More generally, it should be understood that the specific configuration shown in FIG. 1 and in the other figures is merely representative of numerous possible configurations now known or later developed and that variations are therefore possible. For instance, certain components or combinations of components can be combined, distributed, re-positioned, re-ordered, omitted, added, or otherwise modified.

As shown in FIG. 1, external assembly 14 comprises a behind the ear (BTE) speech processing unit 18, connected with a transmit/receive unit 20 having an inductive coupling coil 22. (Alternatively or additionally, other processing units, such as an in-the-ear (ITE) processor or a button-processor, could be used.) The BTE unit includes a microphone 24 for detecting sound, which is then processed by electronics within the BTE unit to generate coded signals, typically including analog to digital conversion. The coded signals are then provided to transmit/receive unit 20, which transmits the signals via coil 22 to the internal component assembly. The BTE unit may further include a battery (not shown) and may be arranged to inductively couple power from the battery to the internal component assembly.

Internal component assembly 16 includes a transmit/receive unit 26 having an inductive coupling coil (not shown) arranged to communicate with external coil 22, so as to facilitate transmission of coded signals and power between the external and internal assemblies. Internal assembly then includes a stimulator unit 28 that is arranged to generate and provide a signal via link 30 to a transducer 32. Transducer 32 is shown positioned at the middle-ear 34. In practice, for instance, the transducer may be surgically positioned to sit on the middle ear bones and arranged such that vibration of the transducer will impact the oval window (e.g. tympanic membrane or stapes) or other stimulation point, so as to deliver vibrations in turn to the cochlea 36.

With this arrangement, in normal operation, when microphone 24 receives audio 38 such as speech, external assembly 14 delivers corresponding coded signals to the internal assembly 16. Stimulator unit 28, in turn, generates a signal having an energy level corresponding with the received coded signals, and thus with the received audio, and uses the signal to drive transducer 32. Transducer 32 then vibrates to an extent corresponding with the energy level of the signal, and the resulting vibration of the middle-ear 34 vibrates fluid in the cochlea 36, which in turn stimulates auditory nerve system 40. This direct acoustic cochlear stimulation mechanism can help to overcome conductive hearing loss issues.

As noted above, the present method can be usefully applied in this type of arrangement by detecting a threshold change in pressure that results from the acoustic reflex, and accordingly setting an operational parameter of the device.

The acoustic reflex (e.g., stapedius reflex or tensor tympani) is an involuntary muscle contraction that occurs in the middle ear of mammals in response to high-intensity sound stimuli. Further, in humans, the stapedius reflex is also invoked when the human vocalizes. In humans, the vocalization-induced stapedius reflex reduces sound pressure levels reaching the inner ear hair cells by approximately 20 decibels, by causing an acousto-mechanical increase impedance.

The acoustic reflex has two different pathways: (i) ipsilateral, which results in acoustic reflex in same ear where the loud sound is received, and (ii) contralateral, which results in acoustic reflex in the contralateral ear, i.e., the other ear. In particular, upon receipt of loud sound in a human ear, the sound waves result in vibration of the middle-ear and in turn the cochlear fluid, which results in stimulation of the auditory nerve and consequent signaling to the superior olivary complex of the brainstem. The brainstem then signals back to the middle ear of both ears, to trigger the acoustic reflex in each ear.

The threshold level of sound required to trigger the acoustic reflex in a person tends to vary with the hearing threshold of person. Further, the uncomfortable loudness level for a person (typically higher than the level that causes the acoustic reflex) will tend to vary depending on the person's hearing threshold. In particular, as the person's hearing threshold increases, the person's uncomfortable loudness level will gradually increase, although normally not linearly. Thus, as a person's acoustic reflex threshold increases, the person's uncomfortable loudness level would likely increase as well. Given this, the present method can help configure the C-level, the most comfortable level, or other such operational parameters of the middle-ear implant.

Further, as noted above, it would be desirable to provide for fitting during or immediately after surgical implantation of the prosthesis. This is particularly so with middle-ear implants, as it is generally quite difficult to predict the exact excitation levels that will correspond with a specific hearing level. One reason for this difficulty is that the excitation levels can differ up to 60 dB depending on the exact location of the implant. By performing a "first fit" during surgery, it may be possible to help ensure that the implant sits in the correct location and to ensure that the patient can hear the signals. Further, the present method again facilitates better prediction of the C-level and the like, so that the implant settings can be optimized right from the start.

Figure 2:
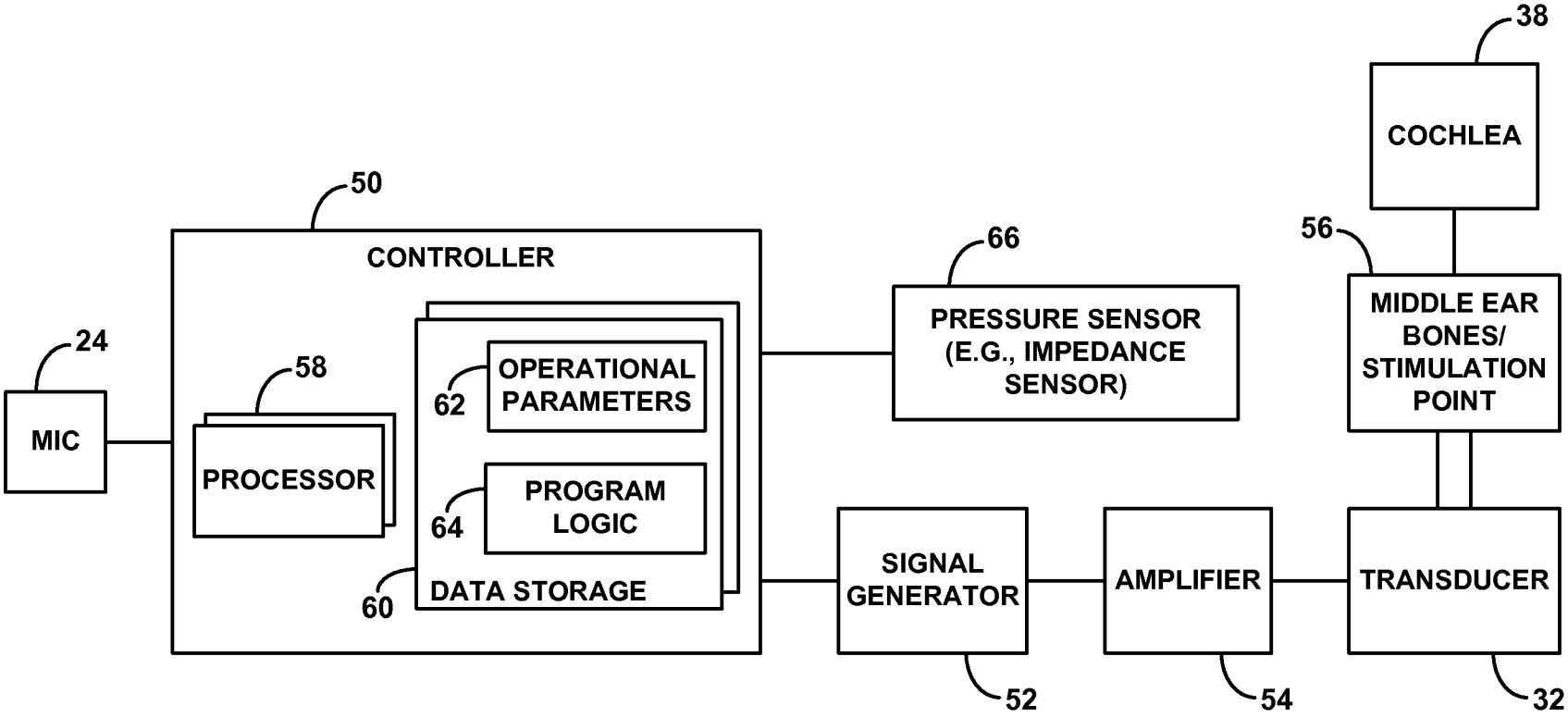
FIG. 2 is a simplified block diagram depicting functional components that may be involved in implementing the method.

FIG. 2 is next a simplified block diagram depicting functional components involved in implementing the method by way of example. The arrangement of FIG. 2 includes a controller 50, a signal generator 52, an amplifier 54, and transducer 32, with the transducer being vibrationally coupled with the middle ear bones 56 so as to facilitate delivering vibrations to the cochlea 36. As noted above, these components can be integrated, distributed or arranged in ways other than that shown.

In the example arrangement, controller 50 functions generally to control operation of the middle-ear implant device in normal practice and further to facilitate implementation of the present method. As such, the controller may be part of the external component assembly 14, including the speech processing unit 18 for instance, or part of the internal component assembly 16, including the stimulator unit 28 for instance, or may include components of both assemblies possibly coupled together by an inductive link or other wireless or wired connection.

Furthermore or alternatively, the controller 50 may include a separate device, such as a portable computer or handheld computing device, which may be communicatively linked with the external assembly and/or internal assembly by a wireless or wired connection. Such a separate device may be arranged to manage implementation of the present method specifically, by controlling components of the external assembly and/or the internal assembly, and may thus be operated by an audiologist, clinician, or other healthcare professional to facilitate automatic configuration of the implant.

As shown, controller 50 may include one or more processors 58, such as one or more general purpose processors (e.g., microprocessors) and/or one or more special purpose processors (e.g., application specific integrated circuits or digital signal processing units). Further, controller 50 may include one or more volatile and/or non-volatile data storage components 60, such as magnetic, optical, organic, or flash memory for instance. As further shown, data storage 60 functions to hold operational parameter data 62 defining one or more operational parameters of the middle-ear implant, such as C-level values for instance. Further, data storage 60 also functions to hold program instructions 64 executable by processor(s) 58 to carry out various functions described herein.

Signal generator 52 functions to generate a signal that drives the transducer. In practice, the signal may be pulse width modulated, having a pulse width that defines its energy level or relative energy level. Signal generator 52 may be implemented by a digital signal processor that is part of controller 50, within the internal assembly or the external assembly. Further, controller 50 may generally control operating of signal generator 52 may be generally controlled by logic of controller 50, to facilitate changing the energy level of the signal such as progressively increasing the energy level until a threshold change in pressure is detected.

Amplifier 54, in turn, functions to amplify the signal produced by signal generator 52, so as to provide an output signal that generates current sufficient to drive the transducer 32. As such, the amplifier could be a class A, B, or D amplifier for instance and could be configured to amplify the output of signal generator 52 to provide a pulse width modulated signal that varies between plus and minus 1 volt or some other designated level. Although the energy level of the pulse width modulated signal is optimally adjusted by varying the width of the pulses as noted above, the energy level could alternatively or additionally be adjusted by varying the amplitude of the pulses or by otherwise adjusting the amplitude of the output signal.

Transducer 32 (also known as an actuator) generally functions to convert between an electrical signal (or perhaps an optical or other signal) and pressure. As such, the transducer may comprise a piezoelectric transducer, and electromagnetic transducer, or other type of transducer now known or later developed.

In the specific context of the example middle-ear implant depicted in FIG. 1, transducer 32 is mounted on the middle ear bones 34 and functions to convert between an electrical signal generated by the signal generator/amplifier 52, 54 and vibrational energy that vibrates the middle ear 34 and in turn the cochlea 36 and thereby stimulates the auditory nerve. Under control of the controller 50, as the signal generator/amplifier increases the energy level of the signal that it provides to drive the transducer, the extent of this vibration to the middle ear and cochlea will correspondingly increase, ultimately resulting in the acoustic reflex.

As further shown in FIG. 2, controller 50 (e.g., speech processor 18 of the external assembly 14) is coupled with microphone 24. In normal operation of the implant, as noted above, the microphone 24 may thus receive audio input such as speech, and the controller 50 may digitize the input and provide a coded signal to the stimulator unit 28. Stimulator unit 28, and particularly signal generator 52 and amplifier 54, may then generate and provide a signal with a corresponding energy level to drive the transducer 32.

In accordance with the present method, controller 50 will be further coupled with a pressure sensor 66, to facilitate detecting when a threshold change in pressure occurs in the implant recipient as the controller is causing a progressive (e.g., step by step) increase in the energy level of the signal that drives the transducer 32. This pressure sensing can be carried out in various innovative ways, regardless of whether an actual "pressure" is determined or other representative measure (e.g., representative change in impedance or other electrical characteristic) is determined As noted above, one way to detect a threshold change in pressure resulting from increase in energy level of the signal that drives the transducer 32 is to detect a threshold change in impedance of the transducer itself, since the transducer 32 will likely experience a change in pressure and corresponding change in electrical impedance when the acoustic reflex occurs. This implementation may thus involve detecting the change in impedance of the very element (the transducer) that is itself causing the vibration that likely triggers the acoustic reflex.

This change in impedance of the transducer 32 can be measured by detecting an electrical change indicative of a change in the impedance. For instance, the change in impedance of the transducer can be measured by monitoring voltage or current across a shunt resistor or other component that is provided in series with the transducer or that is provided in some other configuration such that it would be affected by change in impedance of the transducer. The other component can be provided in the implant device specifically for purposes of detecting a threshold change in impedance of the transducer. Alternatively, the other component can be a component of the implant device that also serves some other purpose in the implant circuit and that is leveraged by the present method to facilitate detecting threshold change in impedance of the transducer. For example, the other component could be an ESD diode or resistor that exists for electrical protection in the implant.

Figure 3:
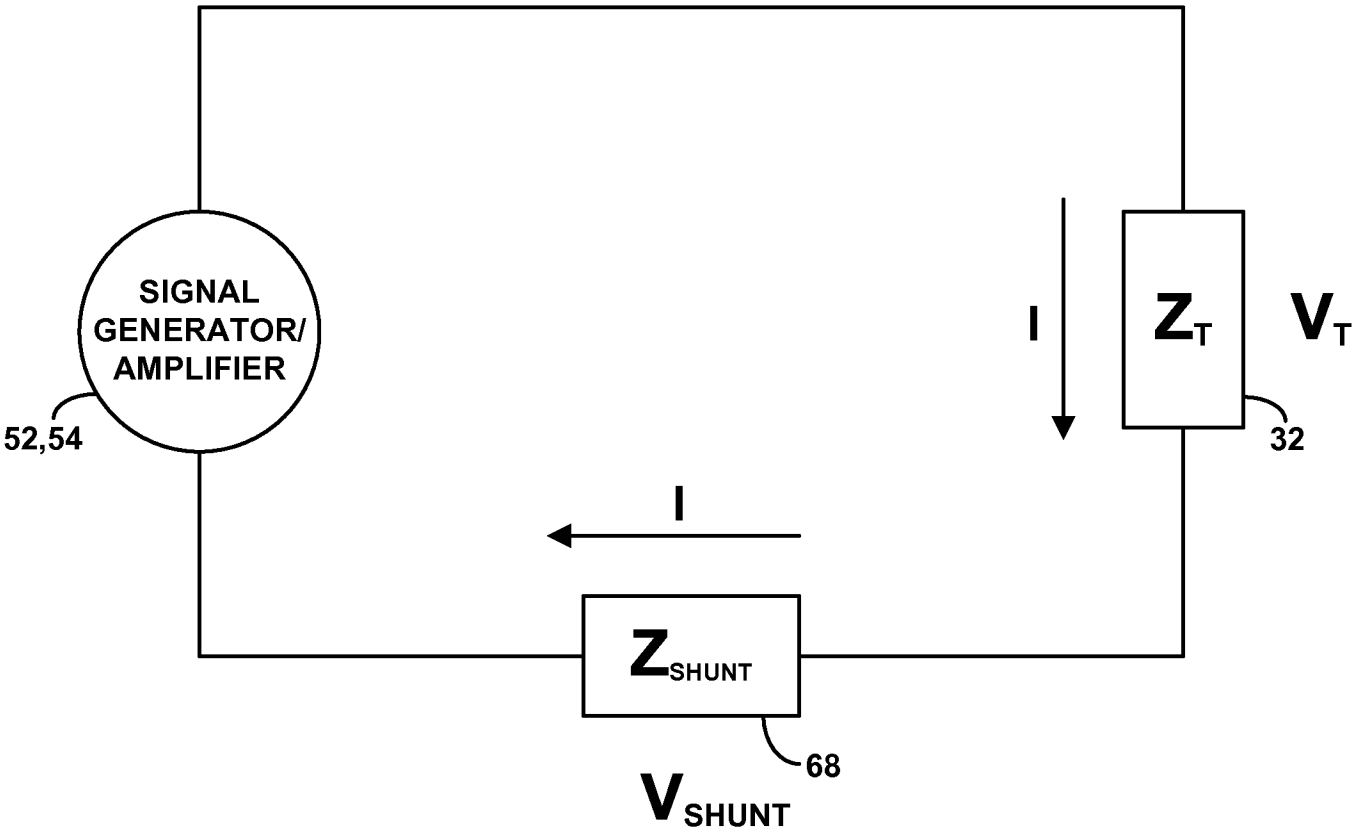
FIG. 3 is circuit diagram depicting an example arrangement for detecting threshold change in impedance of a transducer in accordance with the method.

FIG. 3 depicts a simplified example of one such arrangement.

As shown in FIG. 3, the implant device includes an electrical circuit in which signal generator/amplifier 52, 54 provides a signal with an energy level sufficient to drive transducer 32, and a shunt resistor 68 (e.g., ESD diode or other component) is provided in series between the signal generator/amplifier and the transducer. Optimally, the shunt resistor 68 will have a fixed impedance $Z_{SHUNT}$. Further, in isolation, the transducer will have an impedance $Z_T$, which may or may not be known.

With this arrangement, when the signal generator/amplifier 52, 54 provides a signal of particular energy level to drive the transducer 32, the voltage of that signal would be split between the transducer 32 and the shunt resistor 68 in proportion to the respective impedances of those components. Further, the current that flows through the shunt resistor 68 would be equal to the input signal energy level divided by the sum of the $Z_{SHUNT}$ and $Z_T$.

Consequently, as long as there is no change in the impedance of the transducer, both the voltage and current across the shunt resistor should increase proportionately as the energy level of the input signal increases. However, if and when the energy level of the input signal increases to a point that causes the impedance of the transducer to change (e.g., due to the acoustic reflex as discussed above), the result would be that the change in voltage and current across the shunt resistor would be disproportionate to the change in energy level of the input signal.

As a specific example, assume that the signal generator/amplifier 52, 54 increases the energy level of the input signal in increments of 5 dB. All other factors being equal, the change in current across the shunt resistor should be the same for each step up in input signal energy level, and the change in voltage across the shunt resistor should be the same for each step up in input signal energy level. As soon as a step up in the energy level results in a change in impedance of the transducer, however, the resulting change in current across the shunt resistor will be different than the change in current that was observed for each other step up in energy level. Likewise, the resulting change in voltage across the shunt resistor will also be different than the change in voltage that was observed for each other step up in energy level.

Pressure sensor 66 can be arranged to monitor the voltage or current across shunt resistor 68 and to provide the resulting reading to controller 50. As the controller thus steps up the energy level of the signal that drives the transducer, the controller may determine when there is a disproportionate change in voltage or current across the shunt resistor, at which point controller may note the energy level of the signal and use that energy level as a basis to set the C-level or other operational parameter of the implant device.

The circuit arrangement shown in FIG. 3 is merely one example of possibly many circuit configurations that can be used to detect a threshold change in impedance of the transducer as the energy level of the signal driving the transducer increases. Another example circuit may be a wheatstone bridge, which functions in a known manner to measure an unknown impedance. In practice, such a circuit could be implemented to regularly to more directly measure the electrical impedance of the transducer 32. Other example arrangements are possible as well.

Figure 4:
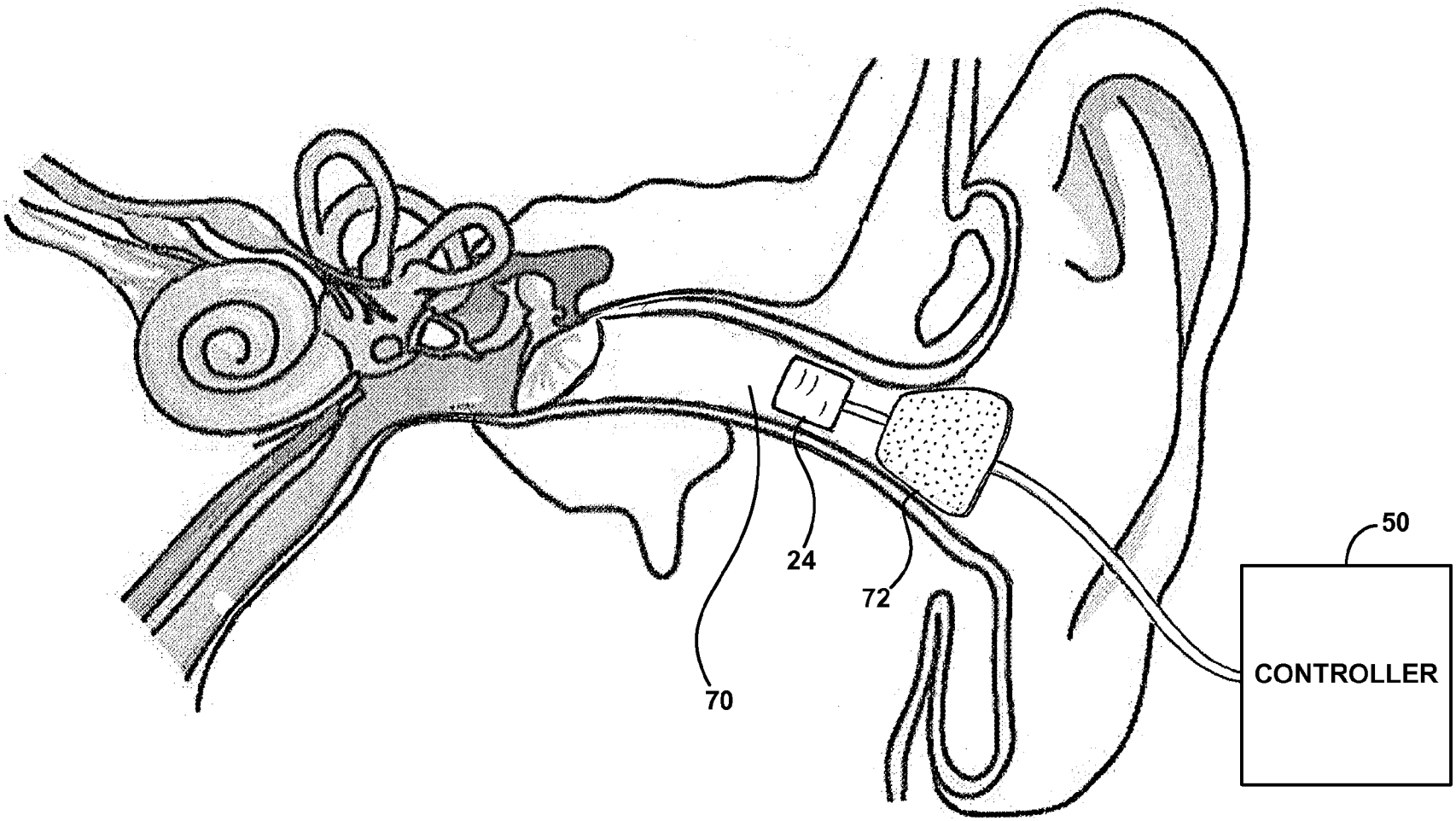
FIG. 4 is a diagram depicting an alternative example arrangement for detecting threshold change in pressure in accordance with the method.

As further noted above, another way to detect a threshold change in pressure resulting from increase in energy level of the signal that drives transducer 32 is to apply a microphone isolated in the recipient's ear canal to detect the change in pressure. FIG. 4 shows such an arrangement by way of example.

As shown in FIG. 4, a microphone 24 is placed within the recipient's ear canal 70, either the same ear in which the middle-ear implant is provided, or the contralateral ear. Further, to help isolate the microphone and allow the microphone to detect a change in pressure within the ear canal, an ear plug 72 may be inserted into the ear canal 70 behind the microphone. Electrical leads to the microphone may be fed through the ear plug and coupled with controller 50 to facilitate monitoring for a change in pressure. Alternatively, the microphone may itself be integrated with an earplug, and the integrated earplug/microphone may be inserted into the recipient's ear canal.

Optimally, the microphone will be positioned as far into the ear canal as is practical and safe (perhaps somewhere on the ossicular chain), so that the microphone can best pick up a change in pressure of the type that may result from the acoustic reflex. In an example implementation, the microphone 24 may be a piezoelectric microphone, which may operate in much the same way that transducer 32 operates to convert between pressure and an electrical signal. Thus, when a sufficient change in pressure occurs within the recipient's ear, a corresponding electrical signal would flow to controller 50, and controller 50 may treat its receipt of that signal as an indication that the acoustic reflex occurred.

In practice, controller 50 may thus progressively step up the energy level of the signal that drives the transducer in the middle-ear implant, while monitoring for a signal from microphone 24 that would indicate threshold pressure change or specifically acoustic reflex. Upon detecting that threshold pressure change, the controller 50 may then note the energy level of the signal and use that energy level as a basis to set the C-level or other operational parameter of the implant device.

In another embodiment, it may be possible to position such a microphone and earplug in the same ear that has the middle-ear implant. Provided that the microphone is situated in the ear canal of that ear close enough to the oval window, stapes, or other portion of the middle ear that would move upon occurrence of the acoustic reflex, the microphone in that ear may equally well pick up a change of pressure, and the energy level of the signal at that point may likewise be used as a basis to set the C-level or other operational parameter of the implant device.

In still another alternative embodiment, a threshold change in pressure in one ear of the recipient may be detected by evaluating a change of impedance of a middle-ear transducer implanted in the recipient's other ear. For instance, if the recipient has middle-ear transducer implants in each ear, the controller 50 could be communicatively linked with and control both implants. In practice, when the energy level of a signal provided to drive one of the transducers reaches a point where the acoustic reflex occurs, the acoustic reflex would occur bilaterally as noted above. Thus, the controller could apply a pressure sensor in the other ear to detect a change of impedance of the transducer in that other ear. Upon detecting that change of pressure, the controller may then likewise set the C-level or other operational parameter accordingly.

Figure 5:
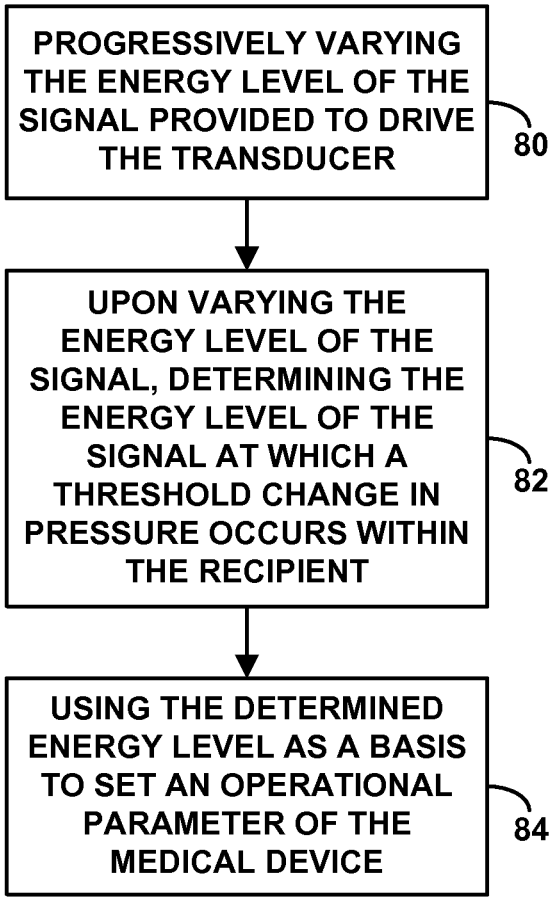
FIG. 5 is a flow chart depicting functions that can be carried out in accordance with an example implementation of the method.

FIG. 5 is next a flow chart depicting functions that can be carried out in accordance with the present method to facilitate setting one or more operational parameters of a medical device such as the middle-ear implant discussed above. Optimally, these functions may be carried out in accordance with logic in the controller 50, so as to automatically configure the medical device to operate comfortably for the recipient. In practice, the method may be initiated by an audiologist or other healthcare professional, such as by switching the controller to an auto-configuration or self-configuration mode for instance.

The example method begins with controller 50 causing signal generator/amplifier 52, 54 to provide a signal with a particular energy level sufficient to drive the transducer in the medical device. In the manner discussed above, this will result in stimulation of a physiological system of the recipient, as the transducer vibrates the middle ear bones and in turn the cochlea, thereby leading to stimulation of the auditory nerve.

As shown in FIG. 5, at block 80, the method then involves progressively varying the energy level of the signal provided to drive the transducer. In practice, this progressive variance of the signal may involve progressively stepping up the energy level of the signal in defined increments, such as 5 dB increments for instance.

This progressive change in the energy level of the signal can be achieved in various ways. By way of example, this function can be carried out by the speech processor 18, which normally functions to receive sounds and to map those sounds to coded signals that result in generation of the corresponding signal to drive the transducer 32. In practice, the speech processor could operate in an auto-configuration mode to internally generate coded signals that correspond with various sounds, such as narrow or wide band limited noise, chirps, sine tones, and so forth, and at various different frequencies. The speech processor may progressively step up the volume of its internally simulated sounds, and the corresponding coded signals may thus trigger progressively higher energy levels of the signal that drives the transducer.

As another example, and to provide greater control over the stepwise increases in energy level of the signal that drives the transducer, the stimulator unit 28 may operate in an auto-configuration mode in which it programmatically causes the signal generator 52 and/or amplifier 54 to progressively step up the energy level of the signal. Other examples may be possible as well.

At block 82, the method then involves, upon varying the energy level of the signal, determining the energy level of the signal at which a threshold change in pressure occurs within the recipient. As noted above, this function may involve determining the energy level of the signal when a threshold change in impedance of the transducer is detected, or more particularly when a disproportionate change in current, voltage, or some other electrical characteristic across another circuit component is detected. Alternatively, this function may involve detecting a threshold change in pressure by applying a microphone in the ear canal or evaluating transducer impedance or other electrical circuit characteristics in either ear.

At block 84, the method next involves using the determined energy level as a basis to set an operational parameter of the medical device. As noted above, an example of such an operational parameter is a maximum allowable energy level of the signal, which may represent the maximum level of the signal before the recipient may experience the sensation of uncomfortable loudness. In particular, with a middle-ear implant of the type discussed above, the operational parameter may be a C-level.

Typically, a person will experience the acoustic reflex at a threshold sound level that is somewhat lower than the level of uncomfortable loudness for the person. Consequently, it would be advantageous to set the C-level of the device to an energy level that is some predefined delta higher than the energy level was at the time the acoustic reflex seems to have occurred. By way of example, the controller could set the C-level to an energy level that is 20 to 30 dB higher than the determined energy level was.

In practice, once the controller 50 has determined the operational parameter value to set, the controller 50 may then record the determined operational parameter value among values 62 in data storage 60. When the middle-ear implant is then used in normal practice, the controller 50 may apply that operational parameter value. For instance, if the operational parameter is a C-level, the controller 50 may limit the energy level of the signal output by the signal generator/amplifier 52, 54 to be no greater than the recorded C-level.

As noted above, the present method can be implemented automatically by or at the direction of controller 50. Thus, the controller or other components operating under direction of or in connection with the controller may represent means for progressively varying the energy level of the signal provided to drive the transducer, means to determine the energy level of the signal at which there is a threshold electrical change indicative of a threshold change in impedance of the transducer, or to determine an energy level of the signal at which a threshold change in pressure occurs within the recipient, and means to use the determined energy level as a basis to configure an operational parameter of the medical device.

Furthermore, a middle-ear implant system may thus be provided with self-configuration functionality, so that when the system is at least partially implanted in a human recipient, the system can be automatically configured in a manner that helps to ensure comfortable use by the recipient. In line with the discussion above, such a system may include a transducer arranged to be mechanically coupled with a middle ear within the recipient, a signal generator for providing a signal to drive the transducer, a circuit component in electrical series with the transducer and signal generator, and a controller that controls the self-configuration process. In particular, the controller may be arranged to (i) to progressively vary energy level of the signal provided by the signal generator, (ii) upon varying the energy level of the signal, to determine the energy level of the signal when a threshold disproportionate change in voltage or current occurs across the circuit component, and (iii) to automatically set an operational parameter of the medical device based on the determined energy level of the signal.

Exemplary embodiments have been described above. It should be understood, however, that numerous variations from the embodiments discussed are possible, while remaining within the scope of the invention.

We claim:

1. A method comprising:

progressively varying an energy level of a signal provided to drive a transducer in a medical device that is at least partially implanted in a human recipient, the transducer being arranged to stimulate a physiological system of the recipient;

upon varying the energy level of the signal, determining the energy level of the signal at which there is a threshold electrical change indicative of a threshold change in impedance of the transducer; and using the determined energy level as a basis to configure an operational parameter of the medical device, wherein determining the energy level of the signal at which there is a threshold electrical change indicative of a threshold change in impedance of the transducer comprises determining when a circuit component in series with the transducer experiences a change in an electrical characteristic that is threshold disproportionate to change in the energy level of the signal provided to drive the transducer, wherein the change in the electrical characteristic is the threshold disproportionate change in the electrical characteristic, whereby the disproportionate change in the electrical characteristic of the circuit component results from the threshold change in impedance of the transducer.

2. The method of claim 1, wherein the circuit component comprises a diode or a resistor.

3. The method of claim 1, wherein the threshold change in impedance of the transducer occurs upon the recipient experiencing an acoustic reflex, thereby changing a pressure against which the transducer vibrates, whereby the determined energy level corresponds with an occurrence of the acoustic reflex.

4. The method of claim 3, wherein the operational parameter of the device comprises a maximum energy level of the signal.

5. The method of claim 4, wherein setting the operational parameter of the device comprises setting the maximum energy level of the signal to be a level that is a predefined delta higher than the determined energy level.

6. The method of claim 5, wherein the predefined delta is 20 to 30 dB.

7. The method of claim 4, wherein the operational parameter defines a comfort level (C-level) for the recipient.

8. The method of claim 1, wherein determining the energy level of the signal at which there is the threshold electrical change comprises, while progressively varying the energy level of the signal provided to drive the transducer:

monitoring the electrical characteristic of the circuit component; and detecting, by the monitoring, when there is the change in the electrical characteristic that is threshold disproportionate to a change in the energy level of the signal provided to drive the transducer.

9. The method of claim 8, wherein the operational parameter of the medical device comprises a maximum energy level of the signal.

10. The method of claim 9, wherein setting the operational parameter of the medical device comprises setting the maximum energy level of the signal to be a level that is a predefined delta higher than the determined energy level.

11. The method of claim 10, wherein the predefined delta is 20 to 30 dB.

12. The method of claim 1, wherein the transducer is implanted in a middle ear of the recipient, and the physiological system comprises an auditory nerve system, wherein driving the transducer causes the transducer to vibrate, which causes the middle ear to vibrate, which leads to vibration of cochlear fluid and in turn stimulation of the auditory nerve system.

13. The method of claim 1, wherein, in normal operation, the medical device generates the signal with an energy level corresponding with an external audio input.

14. The method of claim 1, wherein the medical device comprises a controller, wherein progressively varying the energy level of the signal provided to drive the transducer comprises the controller automatically progressively stepping up the energy level of the signal.

15. The method of claim 1, carried out automatically.

16. The method of claim 1, wherein the circuit component provides electrical protection for an implanted component of the medical device.

17. The method of claim 1, wherein the circuit component serves a function in the medical device beyond being used in the method as a basis to detect the threshold change in impedance of the transducer.

18. A method comprising:

progressively varying an energy level of a signal provided to drive a transducer (i) implanted in a human recipient and (ii) vibrationally coupled with a middle ear of the recipient, the transducer being a component of a medical device and being arranged to stimulate a physiological system of the recipient;

upon varying the energy level of the signal, determining the energy level of the signal at which a circuit component in series with the transducer experiences a change in electrical characteristic that is disproportionate to change in the energy level of the signal; and using the determined energy level as a basis to set an operational parameter of the medical device.

19. The method of claim 18, carried out automatically by a controller.

20. The method of claim 19, wherein the controller is part of the medical device.

21. The method of claim 18, wherein the medical device is a middle-ear hearing assistance device, wherein the disproportionate change in electrical characteristic of the circuit component occurs as a result of a change in impedance of the transducer, and wherein the change in impedance of the transducer occurs as a result of an acoustic reflex in the recipient.

22. The method of claim 21, wherein the operational parameter comprises a maximum energy level of the signal.

23. The method of claim 18, wherein the circuit component provides electrical protection for an implanted component of the medical device.

24. The method of claim 18, wherein the circuit component is arranged serve a function in the medical device beyond being used in the method as a basis to determine the energy level.

25. A middle-ear implant system with automatic self-configuration functionality, the middle-ear implant system comprising:

a transducer arranged to be vibrationally coupled with a middle ear within a human recipient;

a signal generator for providing a signal to drive the transducer;

a circuit component in series with the transducer and the signal generator;

a controller configured to (i) progressively vary an energy level of the signal provided by the signal generator, (ii) upon varying the energy level of the signal, determine the energy level of the signal when the circuit component experiences a change in voltage or current that is threshold disproportionate to change in the energy level of the signal, and (iii) automatically set an operational parameter of the middle-ear implant system based on the determined energy level of the signal, whereby the threshold disproportionate change in voltage or current across the circuit component results from a threshold change in impedance of the transducer.

26. The middle-ear implant system of claim 25, wherein the circuit component comprises a diode or a resistor.

27. The middle-ear implant system of claim 25, wherein the operational parameter comprises a maximum energy level of the signal.

28. The middle-ear implant system of the claim 25, wherein the controller automatically sets the operational parameter to a level that is a predefined delta higher than the determined energy level.

29. The middle-ear implant system claim 28, wherein the predefined delta is 20 to 30 dB.

30. The middle-ear implant system of claim 25, wherein the circuit component provides electrical protection for an implanted component of the middle-ear implant system.

31. The middle-ear implant system of claim 25, wherein the circuit component is arranged to serve a function in the middle-ear implant system beyond being used as a basis to detect the threshold change in impedance of the transducer.

* * * * *